US012446752B2

(12) United States Patent
Movalson

(10) Patent No.: US 12,446,752 B2
(45) Date of Patent: Oct. 21, 2025

(54) MULTI-CHAMBER MOP BUCKET AND MOP BUCKET LID

(71) Applicant: Top Tier Products LLC, Austin, TX (US)

(72) Inventor: Matthew Movalson, Austin, TX (US)

( * ) Notice: Subject to any disclaimer, the term of this patent is extended or adjusted under 35 U.S.C. 154(b) by 354 days.

(21) Appl. No.: 18/320,459

(22) Filed: May 19, 2023

(65) Prior Publication Data

US 2024/0366057 A1 Nov. 7, 2024

Related U.S. Application Data

(63) Continuation of application No. 18/312,508, filed on May 4, 2023, now abandoned.

(51) Int. Cl.

| | |
|---|---|
| ***A47L 13/58*** | (2006.01) |
| ***A47L 13/20*** | (2006.01) |
| ***A47L 13/51*** | (2006.01) |
| ***A47L 13/60*** | (2006.01) |
| *A47L 13/24* | (2006.01) |
| *A47L 13/258* | (2006.01) |

(52) U.S. Cl.

CPC ..... *A47L 13/51* (2013.01); *A47L 13/20* (2013.01); *A47L 13/58* (2013.01); *A47L 13/60* (2013.01); *A47L 13/24* (2013.01); *A47L 13/258* (2013.01)

(58) Field of Classification Search

CPC ..... A47L 13/24; A47L 13/58; A47L 13/60; A47L 13/258; A47L 13/20

USPC ..... 15/147.1, 147.2, 228

See application file for complete search history.

(56) References Cited

U.S. PATENT DOCUMENTS

| | | | | |
|---|---|---|---|---|
| 8,056,179 | B2 * | 11/2011 | Hsu | A47L 13/58 15/264 |
| 8,347,451 | B2 * | 1/2013 | Chen | A47L 13/58 384/903 |
| 8,347,519 | B2 * | 1/2013 | Chen | A47L 13/58 401/122 |
| 8,407,849 | B2 * | 4/2013 | Chen | A47L 13/58 15/260 |
| 9,204,776 | B1 * | 12/2015 | Dinh | A47L 13/256 |
| 9,668,633 | B1 * | 6/2017 | Cervantes | A47L 13/60 |
| 2012/0192373 | A1 * | 8/2012 | Chen | A47L 13/58 15/228 |
| 2015/0305587 | A1 * | 10/2015 | Lentine | A47L 13/20 15/120.2 |
| 2019/0365192 | A1 * | 12/2019 | Harrington | A47L 13/256 |
| 2020/0323334 | A1 * | 10/2020 | Danko | A47L 13/24 |
| 2021/0037959 | A1 * | 2/2021 | Alvarez | B25G 3/30 |

* cited by examiner

*Primary Examiner* — Michael D Jennings
(74) *Attorney, Agent, or Firm* — Michael Bartholomew

(57) ABSTRACT

A lid for a mop bucket is disclosed. The lid includes an attachment mechanism configured to removably attach the lid to a mop bucket. The lid includes a first opening configured to receive clean water. The lid includes a second opening configured to receive: (i) a mop head and (ii) a mop handle that is rotatable with respect to the mop head. The lid includes a third opening configured to allow dirty water to pass through. The lid includes a fourth opening positioned between the first opening and the second opening. The fourth opening is configured to receive a knob attached to the mop bucket such that the knob is rotatable while the knob is received by the fourth opening.

4 Claims, 11 Drawing Sheets

MULTI-CHAMBER MOP BUCKET AND MOP BUCKET LID

FIELD

This invention relates to the field of cleaning tools and, more specifically, to a multi-chamber mop bucket and a mop bucket lid.

BACKGROUND

Mops and mop buckets are used in various cleaning applications. Mop buckets store water for wetting the mop head and/or water removed from the mop head. The mop can then be used to apply the water to a surface to be cleaned.

SUMMARY

A lid for a mop bucket is disclosed. The lid includes an attachment mechanism configured to removably attach the lid to a mop bucket. The lid includes a first opening configured to receive clean water. The lid includes a second opening configured to receive: (i) a mop head and (ii) a mop handle that is rotatable with respect to the mop head. The lid includes a third opening configured to allow dirty water to pass through. The lid includes a fourth opening positioned between the first opening and the second opening. The fourth opening is configured to receive a knob attached to the mop bucket such that the knob is rotatable while the knob is received by the fourth opening.

A mop bucket is disclosed. The mop bucket includes an attachment mechanism configured to receive an attachment mechanism of a lid to removably attach the lid to the mop bucket. The mop bucket includes a first chamber. The first chamber includes a first open top and a first-chamber wall. The first-chamber wall includes a first portion and a second portion. The second portion is shaped to receive a mop head and a mop handle that is rotatable with respect to the mop head. The first-chamber wall includes an opening proximate to a bottom side of the mop bucket. The mop bucket includes a second chamber. The second chamber includes a second open top, a first second-chamber wall, and a second second-chamber wall. The first second-chamber wall includes the second portion of the first-chamber wall. The mop bucket includes a third chamber. The third chamber includes a third open top. The third chamber includes an outlet positioned proximate to the bottom side of the mop bucket. The third chamber includes a third-chamber wall. The third-chamber wall includes the first portion of the first-chamber wall and the second second-chamber wall. The mop bucket includes a rotatable knob coupled to the second portion of the first-chamber wall. The knob includes a lever configured to expose the opening of the second portion of the first-chamber wall when the knob is rotated in a first axial direction and cover the opening when the knob is rotated in a second axial direction opposite to the first axial direction.

A system is disclosed. The system includes a mop bucket. The mop bucket includes an attachment mechanism. The mop bucket includes a first chamber. The first chamber includes a first open top and a first-chamber wall. The first-chamber wall includes a first portion, a second portion, and an opening. The second portion is shaped to receive a mop head and a mop handle that is rotatable with respect to the mop head. The opening is proximate to a bottom side of the mop bucket. The second chamber includes a second open top, a first second-chamber wall, and a second second-chamber wall. The first second-chamber wall includes the second portion of the first-chamber wall. The mop bucket includes a third chamber. The third chamber includes a third open top, an outlet positioned proximate to the bottom side of the mop bucket, and a third-chamber wall. The third-chamber wall includes the first portion of the first-chamber wall and the second second-chamber wall. The mop bucket includes a rotatable knob coupled to the second portion of the first-chamber wall. The knob includes a lever configured to expose the opening of the second portion of the first-chamber wall when the knob is rotated in a first axial direction and cover the opening when the knob is rotated in a second axial direction opposite to the first axial direction. The system includes a lid for the mop bucket. The lid includes an attachment mechanism configured to removably attach the lid to the mop bucket. The lid includes a first opening configured to receive clean water into the first chamber while the lid is attached to the mop bucket. The lid includes a second opening providing access to the second chamber while the lid is attached to the mop bucket. The second opening is configured to receive a mop head and a mop handle that is rotatable with respect to the mop head. The lid includes a third opening configured to allow dirty water to pass through from the third chamber while the lid is attached to the mop bucket. The lid includes a fourth opening positioned between the first opening and the second opening and configured to receive the knob such that the knob is rotatable while the knob is received by the fourth opening.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
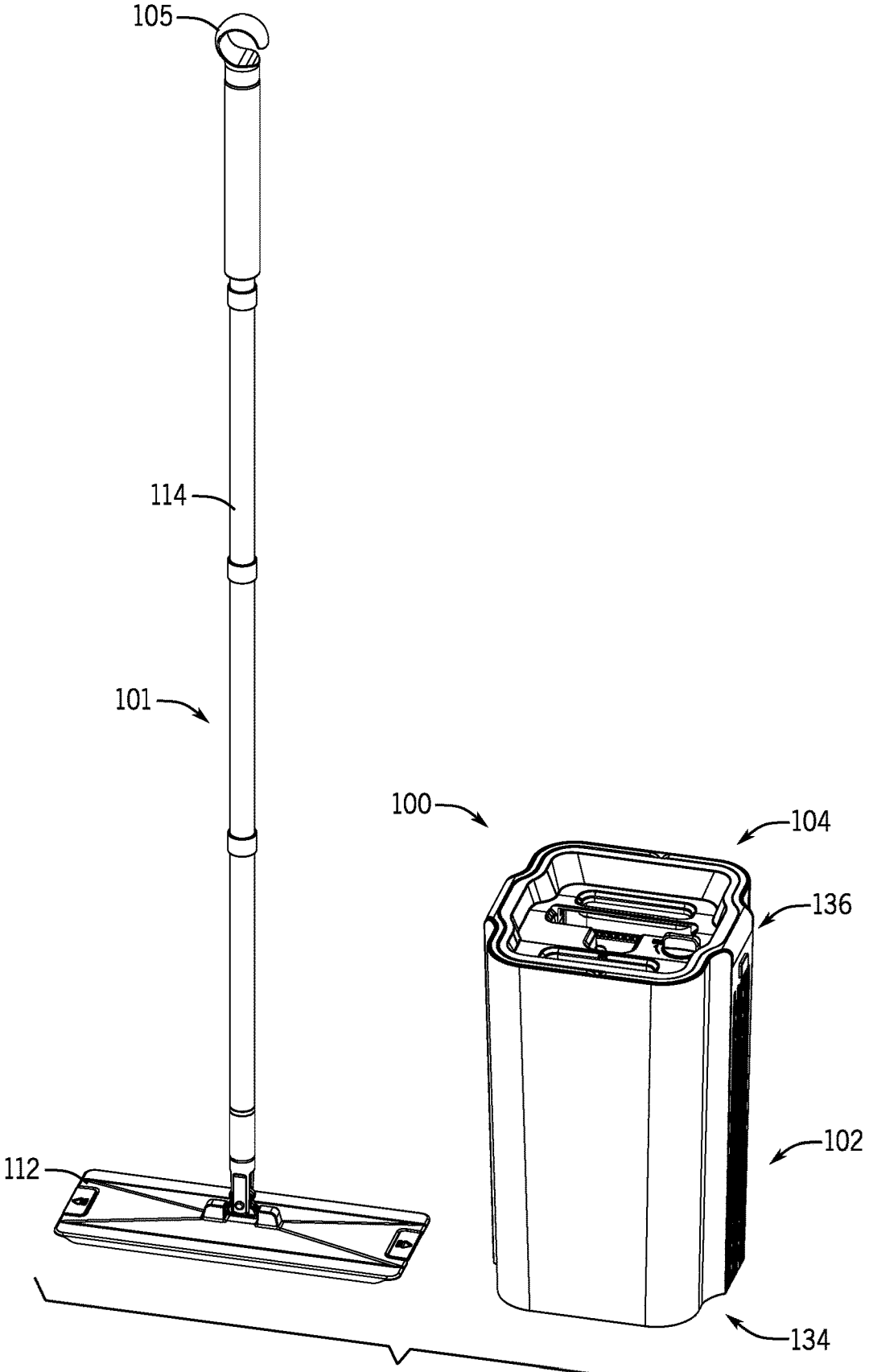
FIG. 1A is a perspective view illustrating a mop and a mop bucket system, according to an embodiment of the present disclosure.

A lid for a mop bucket is disclosed. The lid includes an attachment mechanism configured to removably attach the lid to a mop bucket. The lid includes a first opening configured to receive clean water. The lid includes a second opening configured to receive: (i) a mop head and (ii) a mop handle that is rotatable with respect to the mop head. The lid includes a third opening configured to allow dirty water to pass through. The lid includes a fourth opening positioned between the first opening and the second opening. The fourth opening is configured to receive a knob attached to the mop bucket such that the knob is rotatable while the knob is received by the fourth opening.

In some embodiments, the second opening includes a first edge. The first edge includes an outward protrusion of the second opening shaped to accommodate the handle. The second opening includes a second edge opposite the first edge. The second edge is substantially straight. The second edge includes a scraper facing an interior of the second opening. The scraper is configured to contact the mop head as the mop head moves through the second opening.

In some embodiments, the knob is configured to expose an opening of a wall of the mop bucket when the knob is rotated in a first axial direction and cover the opening when the knob is rotated in a second axial direction opposite to the first axial direction.

In some embodiments, the fourth opening is substantially circular in shape. A length of the first opening is substantially equal to a length of the third opening. A length of the second opening is greater than a length of the first opening and a length of the third opening. A width of the second opening is greater than a width of the first opening, a width of the third opening, and a width of the fourth opening.

In some embodiments, the lid includes a portion configured to accommodate a handle of the mop bucket.

A mop bucket is disclosed. The mop bucket includes an attachment mechanism configured to receive an attachment mechanism of a lid to removably attach the lid to the mop bucket. The mop bucket includes a first chamber. The first chamber includes a first open top and a first-chamber wall. The first-chamber wall includes a first portion and a second portion. The second portion is shaped to receive a mop head and a mop handle that is rotatable with respect to the mop head. The first-chamber wall includes an opening proximate to a bottom side of the mop bucket. The mop bucket includes a second chamber. The second chamber includes a second open top, a first second-chamber wall, and a second second-chamber wall. The first second-chamber wall includes the second portion of the first-chamber wall. The mop bucket includes a third chamber. The third chamber includes a third open top. The third chamber includes an outlet positioned proximate to the bottom side of the mop bucket. The third chamber includes a third-chamber wall. The third-chamber wall includes the first portion of the first-chamber wall and the second second-chamber wall. The mop bucket includes a rotatable knob coupled to the second portion of the first-chamber wall. The knob includes a lever configured to expose the opening of the second portion of the first-chamber wall when the knob is rotated in a first axial direction and cover the opening when the knob is rotated in a second axial direction opposite to the first axial direction.

In some embodiments, the first second-chamber wall includes an outward protrusion of the second chamber shaped to accommodate the handle. In some embodiments, the second second-chamber wall is substantially straight.

In some embodiments, the knob is substantially circular in shape.

In some embodiments, a depth of the first chamber is less than a depth of the second chamber. A depth of the third chamber is greater than or equal to a depth of the second chamber.

In some embodiments, the mop bucket includes a mop bucket handle rotatably coupled to at least one interior surface of the mop bucket.

A system is disclosed. The system includes a mop bucket. The mop bucket includes an attachment mechanism. The mop bucket includes a first chamber. The first chamber includes a first open top and a first-chamber wall. The first-chamber wall includes a first portion, a second portion, and an opening. The second portion is shaped to receive a mop head and a mop handle that is rotatable with respect to the mop head. The opening is proximate to a bottom side of the mop bucket. The second chamber includes a second open top, a first second-chamber wall, and a second second-chamber wall. The first second-chamber wall includes the second portion of the first-chamber wall. The mop bucket includes a third chamber. The third chamber includes a third open top, an outlet positioned proximate to the bottom side of the mop bucket, and a third-chamber wall. The third-chamber wall includes the first portion of the first-chamber wall and the second second-chamber wall. The mop bucket includes a rotatable knob coupled to the second portion of the first-chamber wall. The knob includes a lever configured to expose the opening of the second portion of the first-chamber wall when the knob is rotated in a first axial direction and cover the opening when the knob is rotated in a second axial direction opposite to the first axial direction. The system includes a lid for the mop bucket. The lid includes an attachment mechanism configured to removably attach the lid to the mop bucket. The lid includes a first opening configured to receive clean water into the first chamber while the lid is attached to the mop bucket. The lid includes a second opening providing access to the second chamber while the lid is attached to the mop bucket. The second opening is configured to receive a mop head and a mop handle that is rotatable with respect to the mop head. The lid includes a third opening configured to allow dirty water to pass through from the third chamber while the lid is attached to the mop bucket. The lid includes a fourth opening positioned between the first opening and the second opening and configured to receive the knob such that the knob is rotatable while the knob is received by the fourth opening.

In some embodiments, the second opening includes a first edge. The first edge includes an outward protrusion of the opening shaped to accommodate the handle of the item. The second opening includes a second edge opposite the first edge. The second edge includes a scraper facing an interior of the second opening. The scraper is configured to contact the mop head as the mop head moves through the second opening.

In some embodiments, the system includes a mop bucket handle rotatably coupled to at least one interior surface of the mop bucket.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments.

These features and advantages of the embodiments will become more fully apparent from the following description and appended claims, or may be learned by the practice of embodiments as set forth hereinafter. As will be appreciated by one skilled in the art, aspects of the present invention may be embodied as a system, apparatus, and/or method.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of" includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C. As used herein, "a member selected from the group consisting of A, B, and C and combinations thereof" includes only A, only B, only C, a combination of A and B, a combination of B and C, a combination of A and C or a combination of A, B and C.

FIG. 1A is a perspective view illustrating a mop 101 and a mop bucket system 100, according to an embodiment of the present disclosure. The mop 101 includes a mop handle 114 and a mop head 112. The mop bucket system 100 includes a mop bucket 102 and a mop bucket lid 104 that is configured to removably attach to a top end 136 of the mop bucket 102. The mop bucket 102 includes a bottom end 134 configured to rest on the ground, for example, with or without holding the mop 101.

The mop bucket lid 104 helps to contain water in the mop bucket 102 but allows the mop 101 and/or clean water 139 to be inserted into the bucket 102 while the lid 104 is attached to the bucket 102. The mop bucket lid 104 is removably attached to the mop bucket 102. Embodiments of the present disclosure include mop bucket systems 100 having multiple chambers and configured to separate clean and dirty water. Embodiments of the present disclosure help to facilitate deposit of clean water into the mop bucket 102 and removal of clean water from the mop head 112 and the mop bucket 102.

As used herein, the term "mop head" 112 refers to any component of the mop 101 configured to contact a surface to be cleaned or wetted. For example, as shown in FIG. 1A, the mop head 112 is configured to contact a surface to be cleaned or wetted. In some embodiments, a mop head 112 also includes a removable material configured to contact a surface to be cleaned while attached. For example, the mop head 112 includes a removable cloth. The cloth includes materials such as, but not limited to: microfiber, yarn, sponge, or any combination thereof.

The mop handle 114 is attached to the mop head 112. In some embodiments, the mop handle 114 is removable and/or rotatable with respect to the mop head 112. The mop handle 114 includes, for example, a pole. In some embodiments, the handle 114 is expandable and retractable. Although the mop handle 114, in some embodiments, includes a specific portion configured to be gripped by the user, the term "mop handle 114", as used herein, may refer to any portion of the mop handle 114. In some embodiments, the mop handle 114 includes a hook 105 or another mechanism suitable for facilitating storage of the mop 101.

Figure 1B:
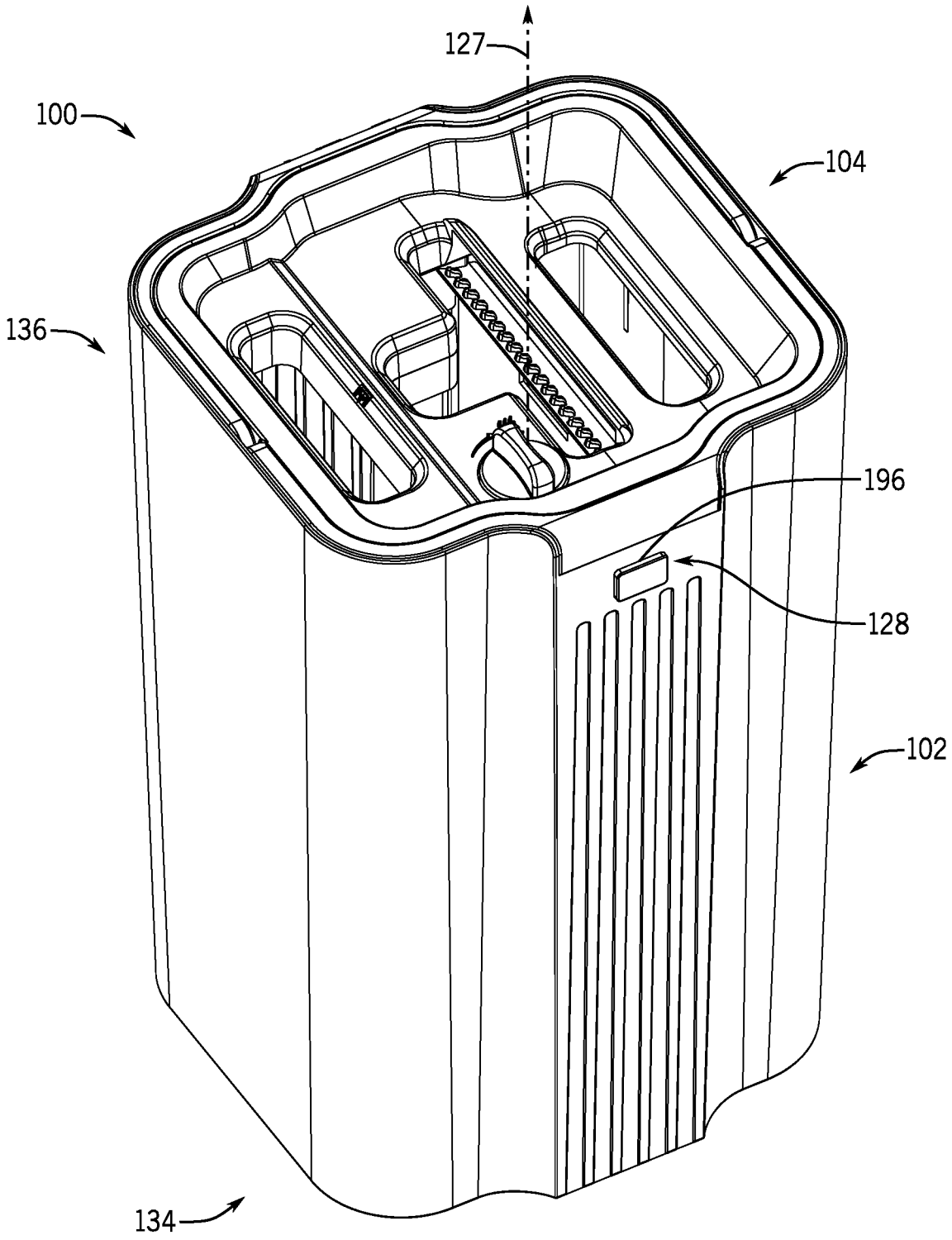
FIG. 1B is a perspective view illustrating a mop bucket system, according to an embodiment of the present disclosure.

FIG. 1B is a perspective view illustrating a mop bucket system 100, according to an embodiment of the present disclosure. The mop bucket system 100 shown in FIG. 1B is an embodiment of the mop bucket system 100 of FIG. 1A.

As shown in FIG. 1B, the mop bucket system 100 is substantially rectangular in shape.

In some embodiments, the mop bucket system 100 includes an attachment mechanism 128 to removably attach the mop bucket lid 104 to the mop bucket 102. For example, as shown in FIG. 1B, the attachment mechanism 128 includes a button 196 configured to secure the mop bucket lid 104 to the mop bucket 102 in its resting position and to release the mop bucket lid 104 from the mop bucket 102 when it is pressed. In some embodiments, the attachment mechanism 128 is positioned close to the top end 136 of the mop bucket 102 than to the bottom end 134 of the mop bucket 102.

Figure 1C:
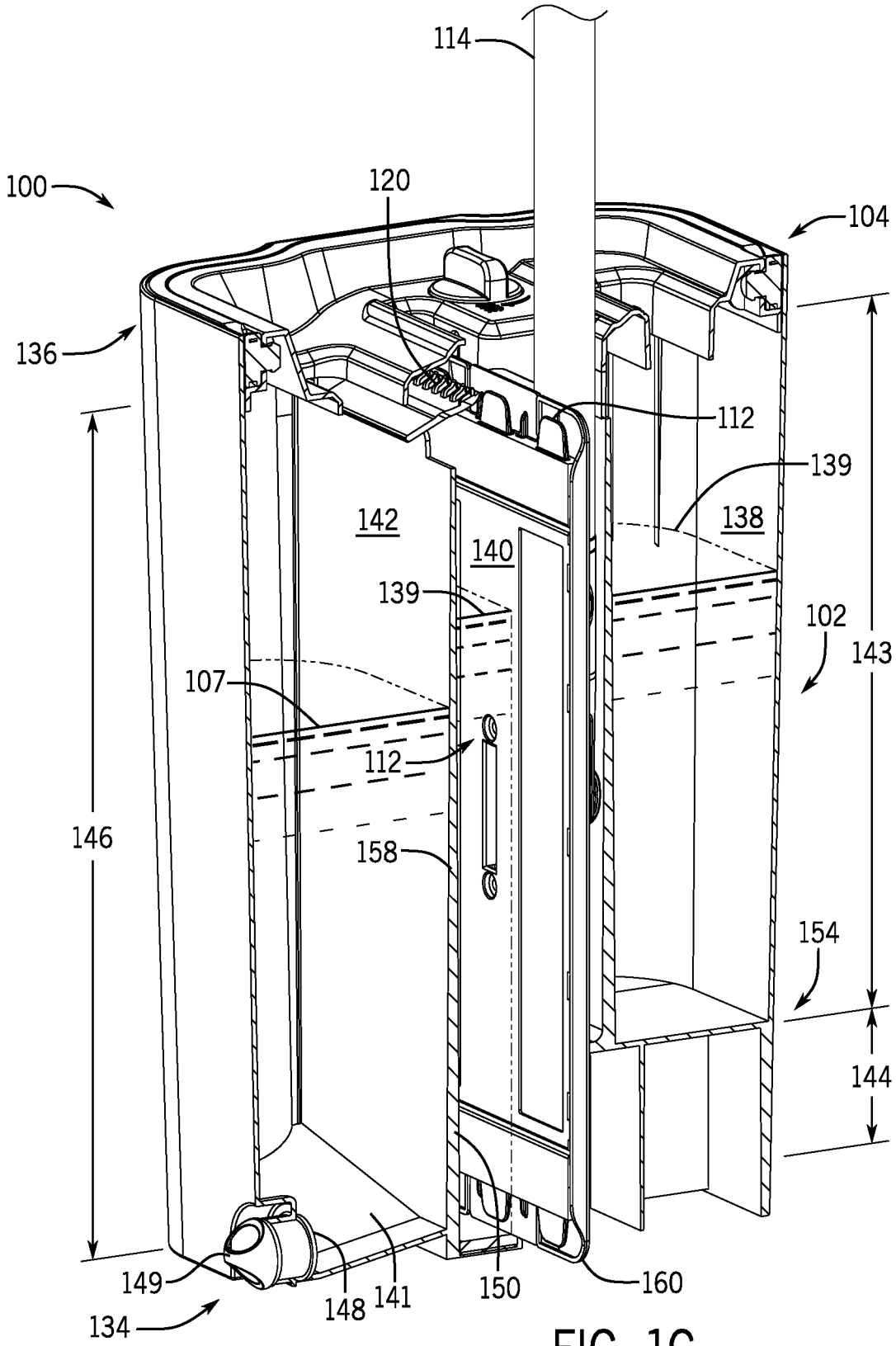
FIG. 1C is a sectional view illustrating a mop bucket system, according to an embodiment of the present disclosure.

FIG. 1C is a cross-sectional view illustrating a mop bucket system 100, according to an embodiment of the present disclosure. The mop bucket system 100 is an embodiment of the mop bucket systems 100 of FIGS. 1A-B. The mop bucket system 100 includes a mop bucket 102 and a mop bucket lid 104. The mop bucket 102 includes a first chamber 138, a second chamber 140, and a third chamber 142. The chambers of the bucket 102 allow for separation of clean water 139 from dirty water 107 with a designated second chamber 140 to receive the mop head 112, remove dirty water 107 from the mop head 112, and wet the mop head 112 with clean water 139.

The first chamber 138 is configured to hold and receive clean water 139. Clean water 139 includes any water that the mop head 112 will be wetted with. In some embodiments, clean water 139 includes water, a cleaning solution, or any combination thereof. In some embodiments, a depth 143 of the first chamber 138 is less than a depth 146 of the second chamber 140. The bottom of the first chamber 138 is lifted at a height 144. The height 144 allows the clean water 139 to drain from the first chamber 138 into the second chamber 140. The mop head 112 absorbs at least some of the clean water 139 from the second chamber 140. Embodiments of the present disclosure help to improve control of flow of clean water 139 from the first chamber 138 to the second chamber 140 to help conserve water.

As shown in FIG. 1C, the mop head 112 and the mop handle 114 are rotatable with respect to each other. As such, the mop head 112 is configured to be folded to fit into the mop bucket 102. For example, the system 100 is configured to receive the folded mop head 112 and mop handle 114 through the second opening 310 of the mop bucket lid 104 shown in FIG. 3A and into the second chamber 140 of the mop bucket 102.

The mop lid 104 includes a scraper 120 configured to contact the mop head 112 as the mop head 112 enters the second chamber 140. The scraper 120 includes any means suitable for removing dirty water and/or dirt from the mop head 112. For example, the scraper 120 includes a toothed surface to remove dirty water and dirt from the mop head 112 by separating fibers of the mop head 112 as the mop head 112 moves against the toothed surface. In other embodiments, the scraper 120 includes a wringer.

The mop bucket 102 includes a third chamber 142 configured to receive dirty water 107 removed from the mop head 112 by the scraper 120. A depth 146 of the third chamber 142 is greater than or equal to a depth 146 of the second chamber 140. The third chamber 140 includes a bottom surface 141 that declines down to an outlet 148, which is an opening in the third chamber 142 and in the bucket 102 itself. The decline of the bottom surface 141 causes dirty water 107 to flow with gravity towards the outlet 148. In some embodiments, the outlet 148 is covered with a plug 149 to prevent dirty water 107 from escaping. The user removes the plug 149 to drain the dirty water 107 from the third chamber 140.

Figure 2A:
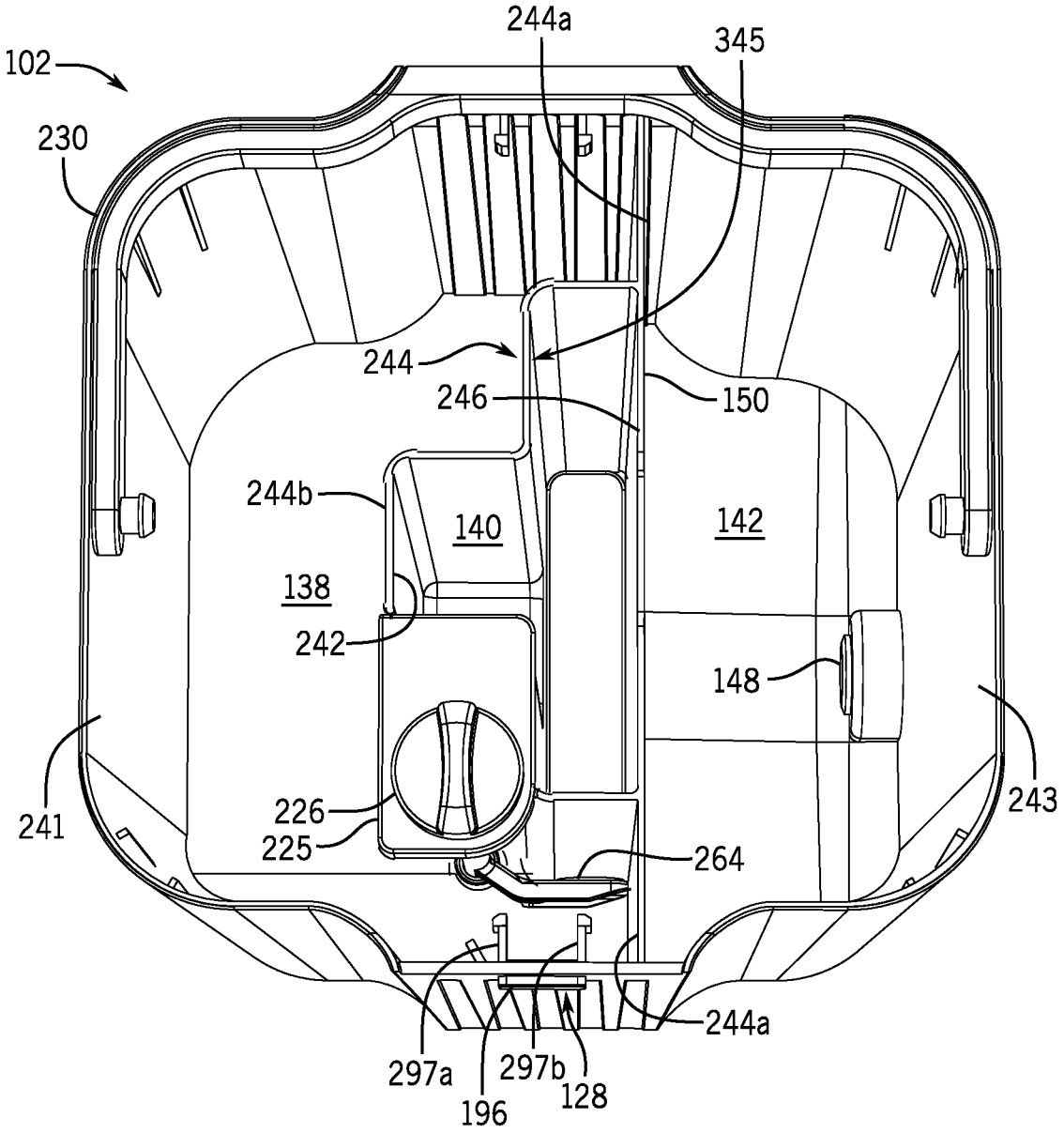
FIG. 2A is a top view illustrating a mop bucket, according to an embodiment of the present disclosure.

FIG. 2A is a top view illustrating a mop bucket 102, according to an embodiment of the present disclosure. The mop bucket 102 includes an attachment mechanism 228, a first chamber 138, a second chamber 240, a third chamber 142, and a knob 226.

The attachment mechanism 228 is configured to mate with an attachment mechanism of a lid (e.g., attachment mechanism 306 of the lid 104 shown in FIG. 3A) to removably attach the lid 104 to the mop bucket 102. For example, the attachment mechanism 228 includes male portions 297*a*, 297*b* configured to be received by a female attachment, such as lid attachment mechanism 306 of FIG. 3A. FIGS. 1A-C show the mop bucket lid 104 attached to the mop bucket 102.

The first chamber 138 includes an open top. In other words, the first chamber 138 is open at the top 136 of the bucket 102. The other sides of the first chamber 138 are closed to contain clean water. The first chamber 138 includes a first-chamber wall 244. The first-chamber wall 244 includes a first portion 244*a* and a second portion 244*b*. The second portion 244*b* is shaped to accommodate a mop head (e.g., mop head 112 shown in FIG. 1C) and at least a portion of a mop handle (e.g., mop handle 114 shown in FIG. 1C) when the mop head 112 is rotated with respect to the handle 114 and inserted into the second chamber 140, as shown in FIG. 1C.

The second chamber 140 also includes an open top. In other words, the second chamber 140 is open at the top end 136 of the mop bucket 102. The second chamber 140 includes two walls. The second portion 244*b* of the first-chamber wall 244 is also a first wall of the second chamber 140, or a first second-chamber wall 245. The second chamber also includes a second second-chamber wall 246. In some embodiments, the first second-chamber wall 245 includes an outward protrusion 247 of the second chamber 240 shaped to accommodate the handle 114.

In some embodiments, the second second-chamber wall 246 is substantially straight. In some embodiments, the second second-chamber wall 246 is shaped to correspond to a surface of the mop head 112. For example, as shown in FIGS. 1A and 1C, the mop head 112 includes a substantially straight surface. In some embodiments, the second chamber 140 is shaped similar to a half cross with rounded corners.

The mop bucket 102 includes the third chamber 142. The third chamber 142 is open at the top end (e.g., end 136 in FIG. 1C) of the bucket 102. The third chamber 142 includes an outlet 248 positioned proximate to the bottom end (e.g., end 134 in FIG. 1C) of the mop bucket 102. The outlet 248 allows dirty water 107 removed from the mop head 112 into the third chamber 142 to be drained out of the bucket 102.

The third chamber includes a third-chamber wall 250. The third-chamber wall 250 includes the first portion 244*a* of the first-chamber wall 244 and the second second-chamber wall 246. In some embodiments, at least a portion of the third-chamber wall 250 has a height that is less than a height of the second second-chamber wall 246. The difference in height allows water removed from the mop head 112 by the scraper 320 to fall into the third chamber 142.

The mop bucket 102 includes the knob 226 coupled to the second portion 244*b* of the first-chamber wall 244. In some embodiments, the knob is coupled to the second portion 244*b* of the first-chamber wall 244 via a platform 225 that is substantially perpendicular to and attached to the second portion 244*b* of the first-chamber wall 244. Additionally or alternatively, in some embodiments, the knob 226 is coupled to the first portion 244*a* of the first-chamber wall 244. In some embodiments, the platform 225 is attached to the first portion 244*a* of the first-chamber wall 244 in addition or alternative to the second portion 244*b* of the first-chamber wall 244.

As shown in FIG. 2A, in some embodiments, the knob 226 is substantially circular in shape. However, examples of the present disclosure are not so limited. The knob 226 may include any suitable shape to be rotated. In some embodiments, the knob 226 includes a tab or handle configured to be gripped by the user as the user manually rotates the knob 226. As shown in FIG. 1B, the knob 226 is configured to rotate about an axis 127. The axis 127 is substantially perpendicular to a virtual plane of the mop bucket lid 104. For example, the axis 127 is substantially perpendicular to the virtual plane 'X' shown in FIG. 3A. The axis 127 is coming out of the page in FIG. 2A. As described in connection with FIGS. 2B and 3D, the knob 226 is connected to a flap 264 that controls flow of clean water 139 between the first chamber 138 and the second chamber 140.

In some embodiments, the mop bucket 102 includes a mop bucket handle 230 rotatably coupled to at least one interior surface of the mop bucket 102. For example, as shown in FIG. 2A, the mop bucket handle 230 is coupled to a surface 241 facing the first-chamber wall 244 and to a surface 243 facing the third-chamber wall 250. In some embodiments, the first chamber 138 and the third chamber 142 are each shaped to substantially correspond with a shape of the mop bucket handle 230 when the mop bucket handle 230 is in a resting position within the mop bucket 102.

Figure 2B:
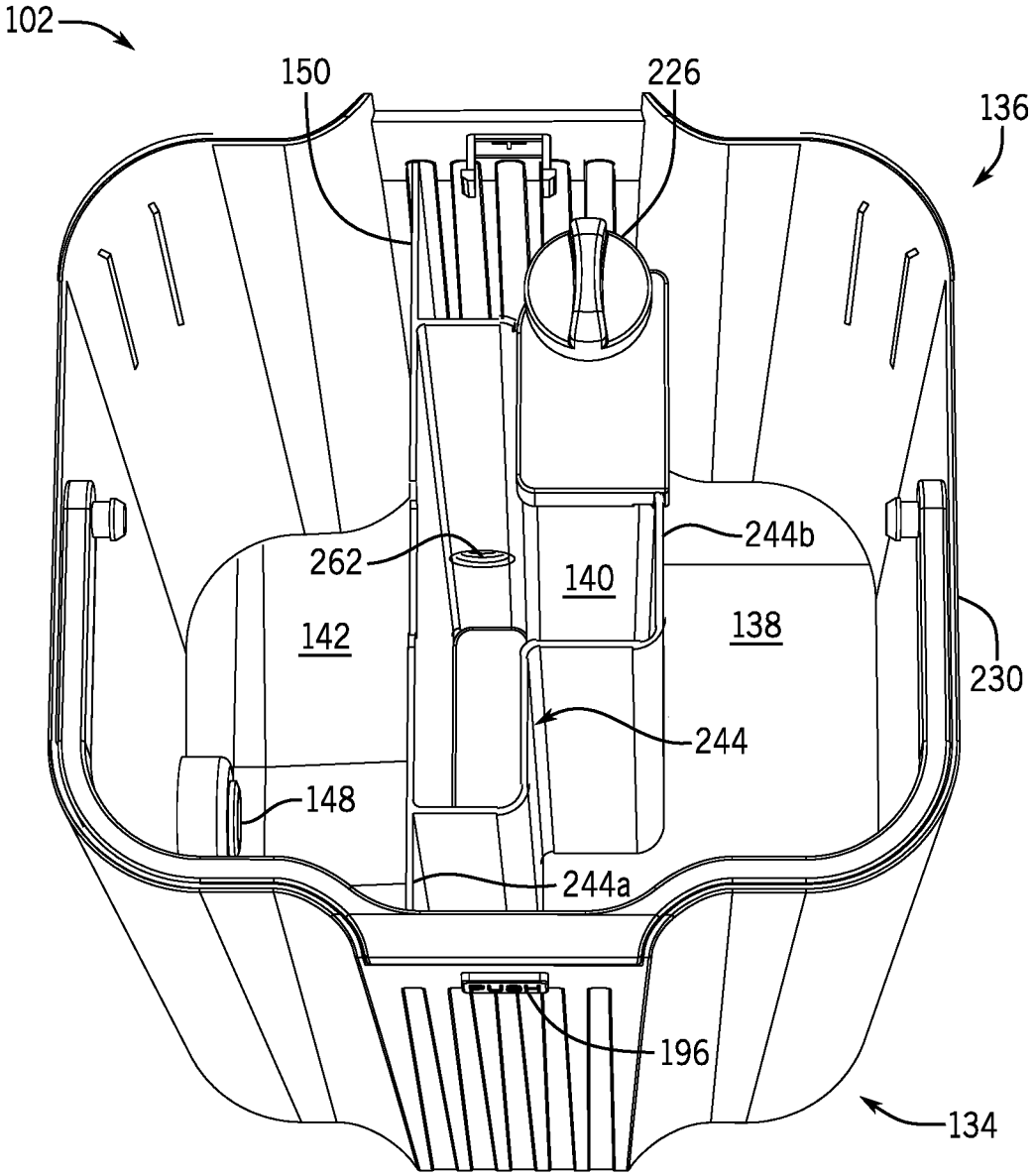
FIG. 2B is a top perspective view illustrating a mop bucket, according to an embodiment of the present disclosure.

FIG. 2B is a top perspective view illustrating a mop bucket 102, according to an embodiment of the present disclosure. The mop bucket 102 is an embodiment of the mop bucket 102 of FIGS. 1A-C and FIG. 2A. As shown in FIG. 2B, the first-chamber wall 244 includes an opening 262 proximate to a bottom end 134 of the mop bucket 102. The opening 262 allows for water to flow between the first chamber 138 and the second chamber 140. Specifically, the opening 262 allows clean water 139 to flow from the first chamber 138 to the second chamber 140.

Figure 3A:
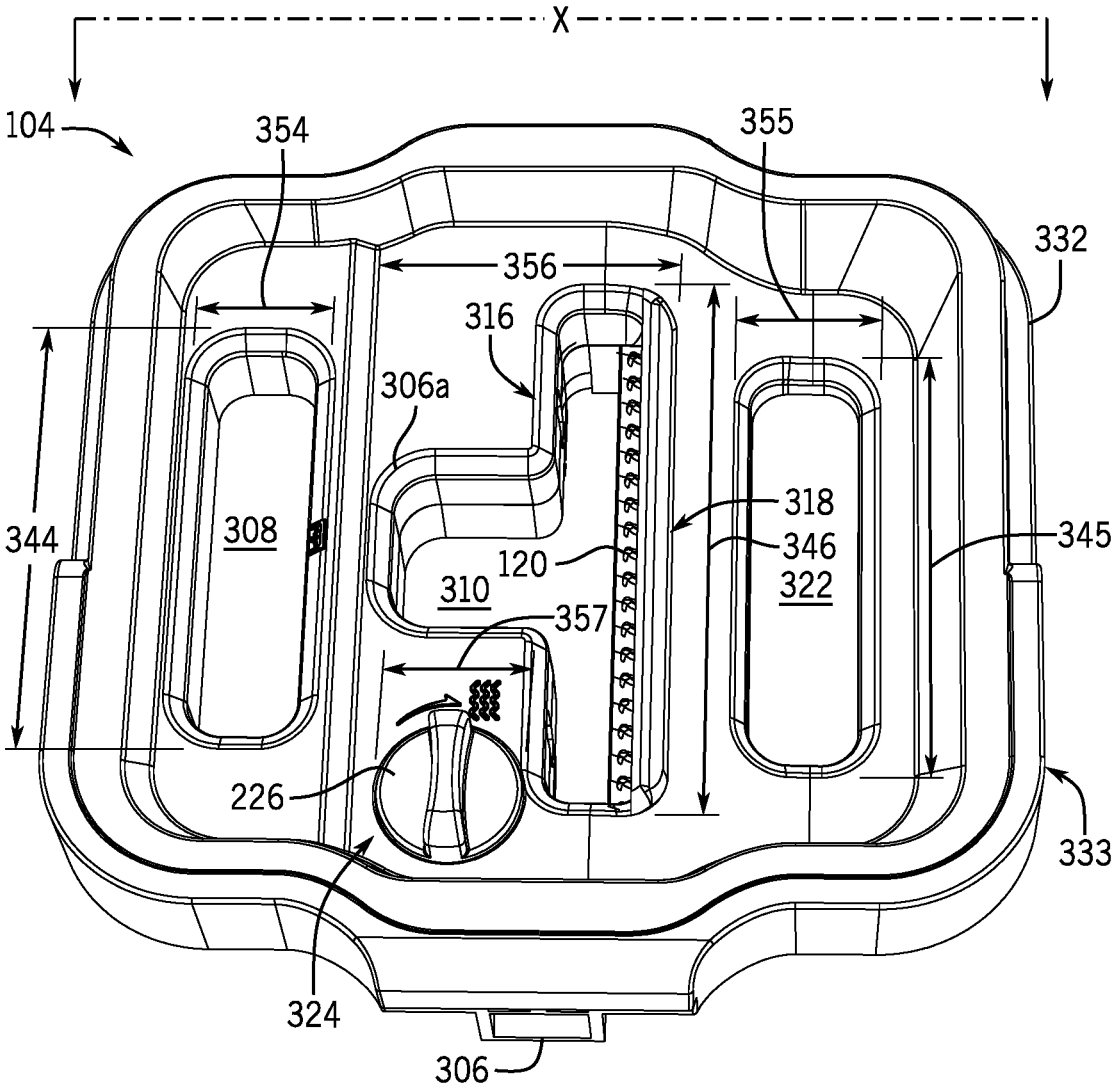
FIG. 3A is a top view illustrating a lid for a mop bucket, according to an embodiment of the present disclosure.
Figure 3B:
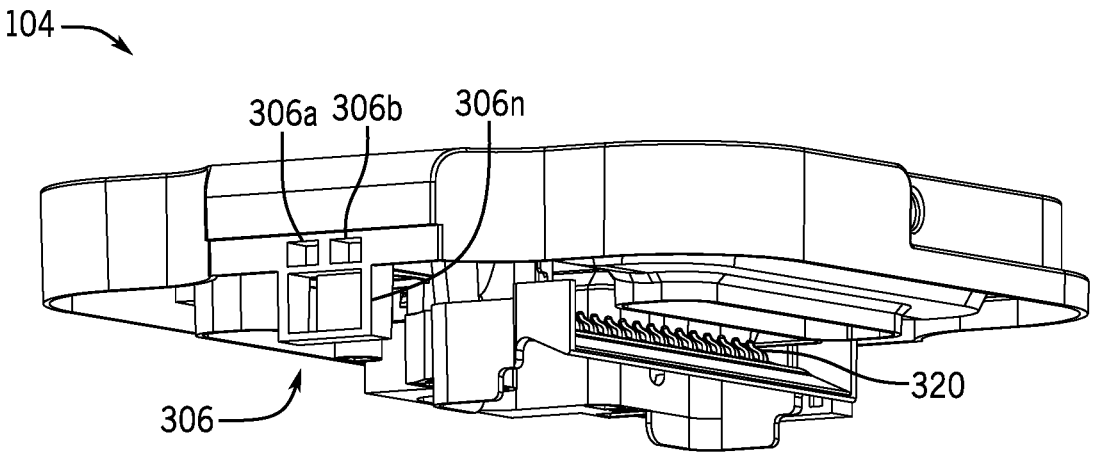
FIG. 3B is a side view illustrating a lid for a mop bucket, according to an embodiment of the present disclosure.
Figure 3C:
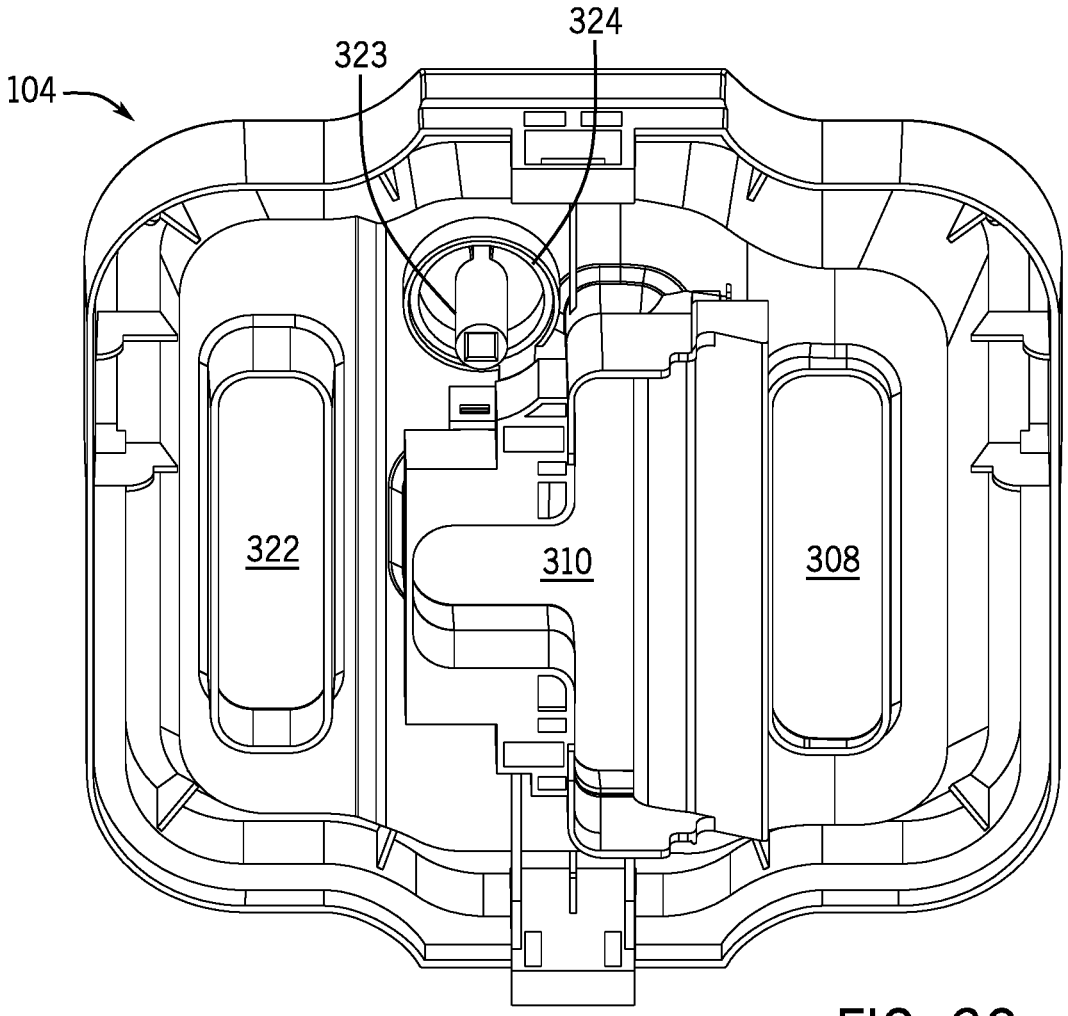
FIG. 3C is a bottom view illustrating a lid for a mop bucket, according to an embodiment of the present disclosure.
Figure 3D:
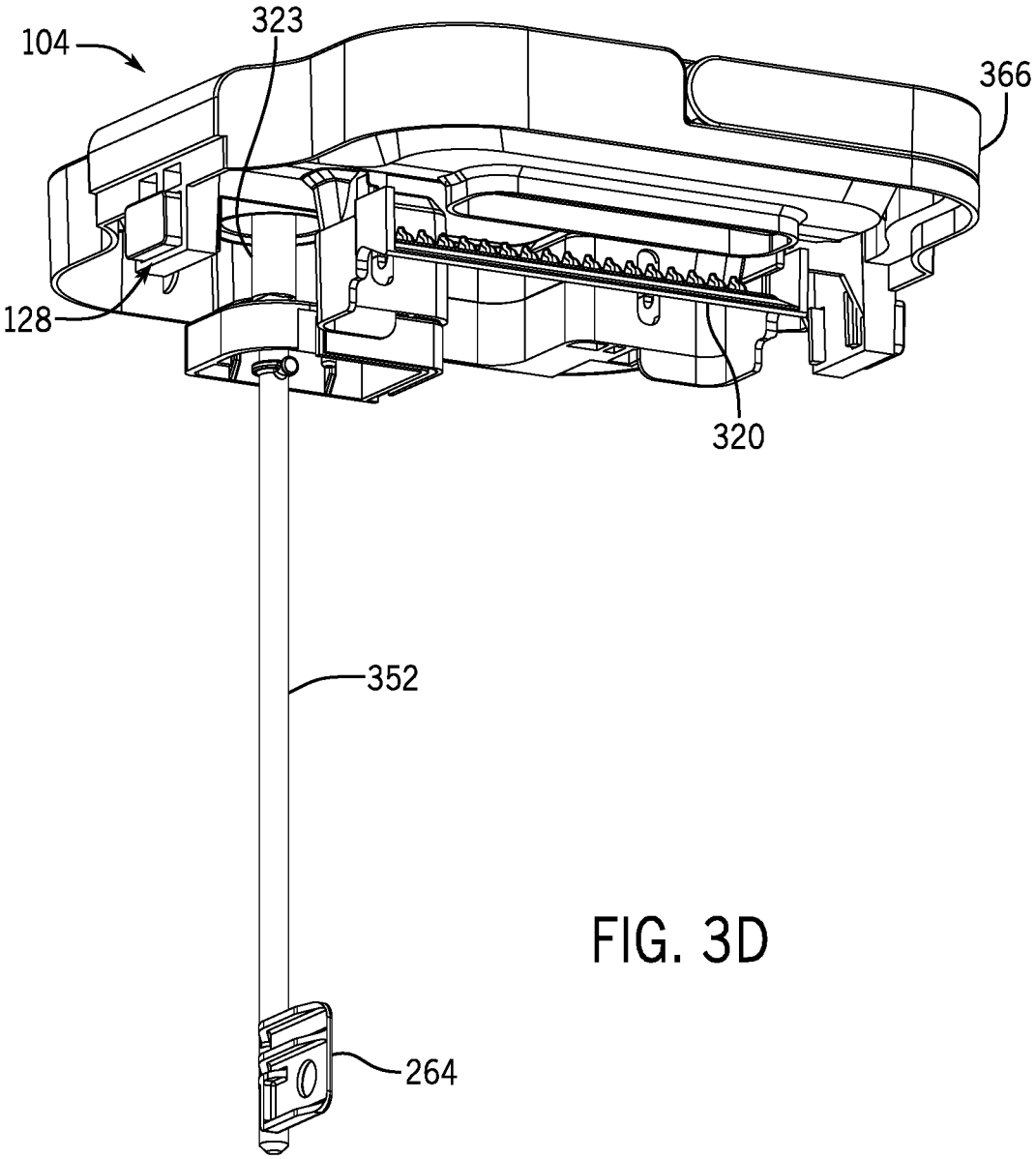
FIG. 3D is a bottom perspective view illustrating a lid and lever for a mop bucket, according to an embodiment of the present disclosure.

As shown in FIG. 3D, the knob 226 includes a lever 352 with a flap 264 configured to expose the opening 262 when the knob is rotated in a first axial direction about the axis 127 and cover the opening 262 when the knob 226 is rotated in a second axial direction about the axis 127 opposite to the first axial direction. In some embodiments, rotating the knob 226 in a first axial direction also rotates the flap 264 in the first axial direction via the lever 352. In some embodiments, rotating and/or lifting the knob 226 lifts the flap 264 in a direction parallel to the axis 127 in order to expose the opening 262.

In some embodiments, the opening 262 is circular. However, embodiments of the present disclosure are not so limited. The opening 262 has a width that is less than a width of the flap 264.

FIG. 3A is a top view illustrating a lid 104 for a mop bucket 102, according to an embodiment of the present disclosure. As shown in FIG. 3A, the lid 104 includes a lid attachment mechanism 306, a first opening 308, a second opening 310, a third opening 322 and a fourth opening 324. The lid 104 of FIG. 3A is an embodiment of the mop bucket lid 104 of FIGS. 1A-C.

The first opening 308 is configured to receive clean water. When the lid 104 is attached to the mop bucket 102, the first opening 108 receives clean water (e.g., clean water 139 of FIG. 1C) into the first chamber 138. In some embodiments, a length 344 of the first opening 308 is more than twice a width 354 of the first opening 308.

The second opening 310 is configured to provide access to the second chamber 240 while the lid 104 is attached to the mop bucket 102. In some embodiments, the second opening 310 has a perimeter that is similar or equal to the perimeter of the second chamber 140. The second opening 310 is configured to receive the mop head 112 and the mop handle 114. For example, the second opening 310 is configured to receive the mop head 112 and the mop handle 114 when the mop head 112 is rotated with respect to the handle 114 into a folded position, as shown in FIG. 1C.

In some embodiments, the second opening 310 includes a first edge 316. The first edge 316 is shaped similarly to the first second-chamber wall 245, shown in FIG. 2A. The first edge 316 includes an outward protrusion 316*a* of the second opening 310 that is shaped to accommodate the handle 114. For example, the outward protrusion 316*a* matches the shape of the outward protrusion 247 of the first second-chamber wall 245.

The second opening 310 includes a second edge 318 opposite the first edge 316. In some embodiments, the second edge 318 is substantially straight. The shape of the second edge 318 is substantially similar to the shape of the second second-chamber wall 150 of the mop bucket 102. The second edge 318 includes a scraper 120 facing an interior of the second opening 310. The scraper 320 is configured to contact the mop head 112 as the mop head 112 moves through the second opening 310. The scraper 320 removes dirty water from the mop head, emptying the dirty water (e.g., dirty water 107 of FIG. 1C) into the third chamber 142 when the mop bucket lid 104 is attached to the mop bucket 102.

The third opening 322 is configured to allow dirty water to pass through. For example, the third opening 322 allows dirty water to pass from the third chamber 142 shown in FIGS. 1C and 2A to an exterior of the mop bucket 102 when the mop lid 104 is attached to the mop bucket 102. In some embodiments, the third opening 322 is shaped substantially similarly to the first opening 308. A length 344 of the first opening 308 is substantially equal to a length 345 of the third opening 322.

In some embodiments, a length 346 of the second opening 310 is greater than a length 344 of the first opening 308 and a length 345 of the third opening 322. A length 346 of the second opening 310 is greater than or equal to a width of a mop head 112 to be placed through the second opening 310. A width 356 of the second opening 310 is greater than a width 354 of the first opening 308, a width 355 of the third opening 322, and a width 357 of the fourth opening 324.

In some embodiments, a surface 399 of the mop bucket lid 104 includes each of the first opening 308, second opening 310, third opening 322, and fourth opening 324. The first opening 308 is adjacent to the second opening 310 and the fourth opening 324. The second opening 310 is adjacent to the first opening 308, fourth opening 324, and third opening 322. The third opening 322 is adjacent to the second opening 310. The surface 399 slopes slightly downward from the virtual plane 'X.' The direction of the slope is away from the first opening 308 and towards the third opening 322 such that the height of the third opening 322 is slightly less than the height of the first opening 308 and/or the height of the second opening 310.

In some embodiments, the fourth opening 324 is positioned between the first opening 308 and the second opening 310. The fourth opening 324 is configured to receive a knob 226 of the mop bucket 102 such that the knob 226 is rotatable while the knob 226 is received by the fourth opening 324. Although FIG. 3A shows the knob 226 with the mop bucket lid 104, embodiments of the present disclosure include the knob 226 being attached to or part of the mop bucket 102. When the mop bucket lid 104 is placed over the mop bucket 102, the knob 226 goes through the fourth opening 324. In some embodiments, the fourth opening 324 is substantially circular in shape. A shape of the fourth opening 324 corresponds to the shape of the knob 326.

The attachment mechanism 306 is configured to removably attach the lid 104 to the mop bucket 102. The attachment mechanism 306 mates with an attachment mechanism of the mop bucket 102, such as bucket attachment mechanism 228 of FIG. 2A. For example, as shown in FIG. 3A, the lid attachment mechanism 306 is a female portion configured to receive a number of male portions 297*a*, 297*b* of the bucket attachment mechanism 128 shown in FIG. 2A.

In some embodiments, the mop bucket lid 104 includes a portion 332 configured to receive a mop bucket handle 230. For example, as shown in FIG. 3A, the portion 332 includes an indentation along approximately half of a perimeter 333 of the mop bucket lid 104. The depth of the indentation is approximately equal to a thickness of the mop bucket handle 230. In some embodiments, the perimeter 333 of the mop bucket lid 104 is slightly less than a perimeter of the mop bucket 102 such that the mop bucket lid 104 rests within the mop bucket 102 but proximate to the top end 136 of the mop bucket 102.

FIG. 3B is a side view illustrating mop bucket lid 104, according to an embodiment of the present disclosure. Mop bucket lid 104 is an embodiment of the mop bucket lid 104 described in connection with FIGS. 1A-C and FIG. 3A.

As shown in FIG. 3B, in some embodiments, the attachment mechanism 306 includes a plurality of female portions 306*a*, . . . , 306*n*. A number 306*a*, 306*b* of female portions of the plurality of female portions 306*a*, . . . , 306*n* are configured to receive male portions 297*a*, 297*b* of the mob bucket attachment mechanism 128, as shown in FIG. 2A. Another portion 306*n* of the plurality of female portions 306*a*, . . . , 306*b* is configured to receive a button 196 of the mop bucket attachment mechanism 128.

As shown in FIG. 3B, in some embodiments, the scraper 320 is angled away from the mop bucket lid 104 and towards the third chamber 322, helping the dirty water separated from the mop head 112 to flow into the third chamber 322 faster.

FIG. 3C is a bottom view illustrating an embodiment of the mop bucket lid 104. FIG. 3C shows the fourth opening 324. As shown in FIG. 3C, the knob 226 includes a knob attachment portion 323 configured to receive an end of the lever 352 shown in FIG. 3D.

FIG. 3D is a bottom perspective view illustrating an embodiment of the mop bucket lid 104. FIG. 3D illustrates the mop bucket attachment mechanism 128 received by the mop lid attachment mechanism 306. FIG. 3D also illustrates the lever 352 and flap 264 attached to the knob 226 of the mop bucket 102. The mop bucket attachment mechanism 128, lever 352, flap 264, and knob attachment portion 323 are shown without the other components of the mop bucket 102 for ease of illustration.

In some embodiments, the mop bucket lid 104 includes a mop bucket lid handle 366 that is rotatable with respect to the mop bucket lid 104. The mop bucket lid handle 366 is positioned within the indentation of the receiving portion 332. In some embodiments, the mop bucket lid 104 includes the mop bucket lid handle 366, and the mop bucket 102 does not include an additional handle.

Figure 4A:
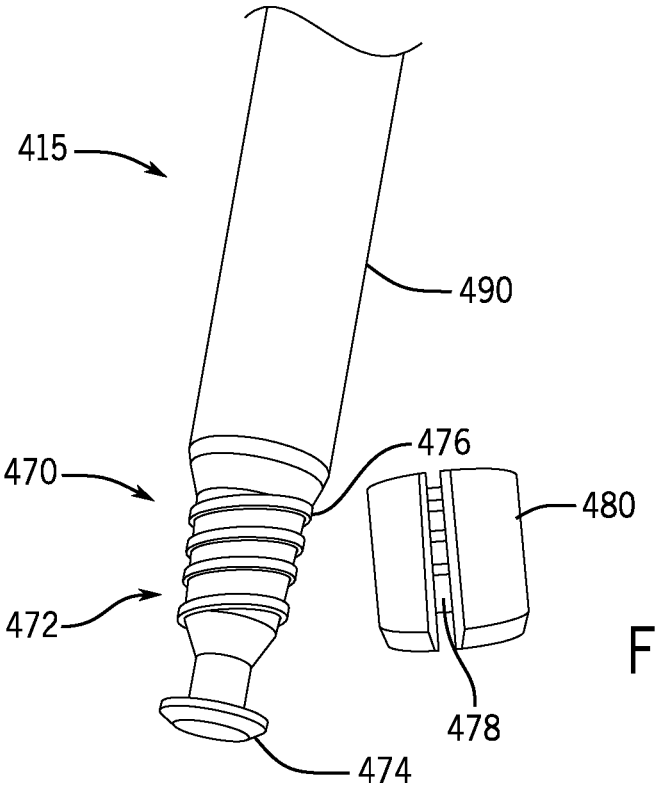
FIG. 4A is a side view illustrating an unassembled pole connector system of a mop handle, according to an embodiment of the present disclosure.

FIG. 4A is a side view illustrating an unassembled pole connector system 415, according to an embodiment of the present disclosure. The pole connector system 415 is a feature of an embodiment of the mop handle 414 illustrated in FIGS. 1A-1C. The pole connector system 415 helps to facilitate customization of mop handle 114 lengths and retraction of the mop handle 114 for storage.

As shown in FIG. 4A, the pole connector system 414 includes a first pole 490, a first pole end 470, and a removable pole end sleeve 480. The pole end 470 includes an end peg 474 an a sleeve attachment mechanism 472. In some embodiments, the sleeve attachment mechanism 472 is tapered from the first pole 490. The sleeve attachment mechanism 472 includes grooves 476 that correspond to grooves 478 in the pole end sleeve 480. For example, the grooves 476 and 478 are spiral configurations.

As shown in FIG. 4A, the pole end sleeve 480 is slightly open. In some embodiments, the pole end sleeve 480 is made of a flexible material. The end peg 474 has a head diameter such that the end peg 474 fits through the pole end sleeve 480, as shown in FIG. 4B.

Figure 4B:
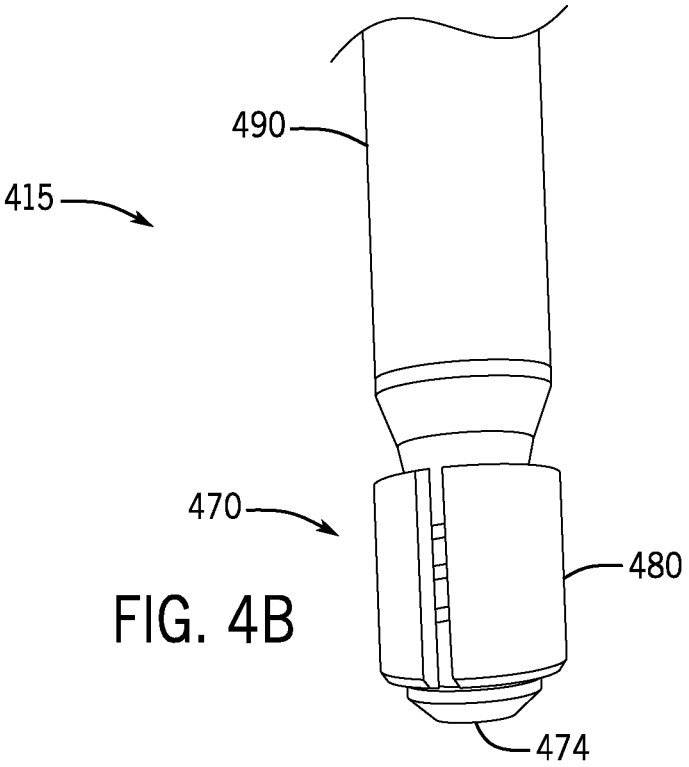
FIG. 4B is a side view illustrating an assembled pole connector system of a mop handle, according to an embodiment of the present disclosure.

FIG. 4B is a side view illustrating the pole end sleeve 480 attached to the pole end 470, according to an embodiment of the present disclosure. In some embodiments, the pole end sleeve is attached to the first pole end 470 by rotating the pole end sleeve 480 along the grooves of the sleeve attachment mechanism 472 until the end peg 474 is visible through the removable pole end sleeve 480. In some embodiments, the pole end sleeve 480 is substantially cylindrical in shape.

Figure 4C:
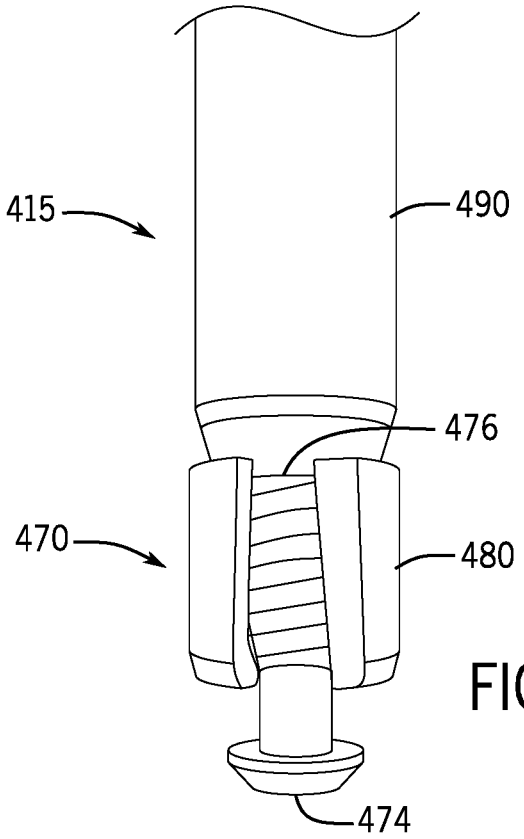
FIG. 4C is an additional side view illustrating an assembled pole connector system of a mop handle, according to an embodiment of the present disclosure.

FIG. 4C is an additional side view illustrating the pole end sleeve 480 attached to the pole end 470, according to an embodiment of the present disclosure. When inserted into a second pole end (e.g., second pole end 473 of FIG. 4D), the pole end sleeve 480 helps to strengthen the connections between the poles (e.g., first pole 490 and second pole 492 of FIG. 4E) and the mop handle 414 as a whole.

Figure 4D:
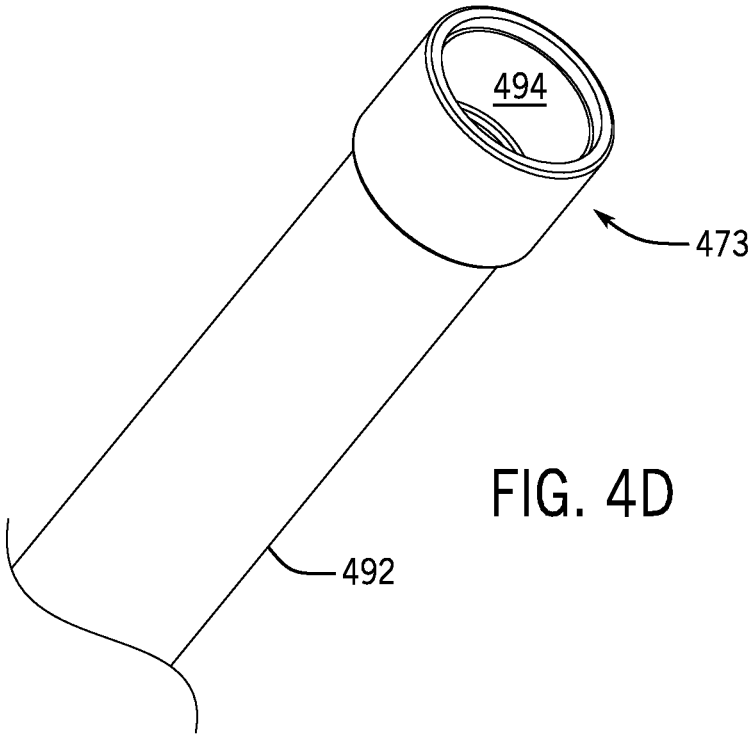
FIG. 4D is a perspective view illustrating a pole end of a pole connector system of a mop handle, according to an embodiment of the present disclosure.

FIG. 4D is a perspective view illustrating a second pole end 473 of an unassembled mop handle 414. The second pole end 473 is an end of a second pole 492 of the mop handle 414. As shown in FIG. 4D, the second pole end 473 includes an opening 494. The opening 494 is of a sufficient width to receive the first pole end 472 with the sleeve 480.

Figure 4E:
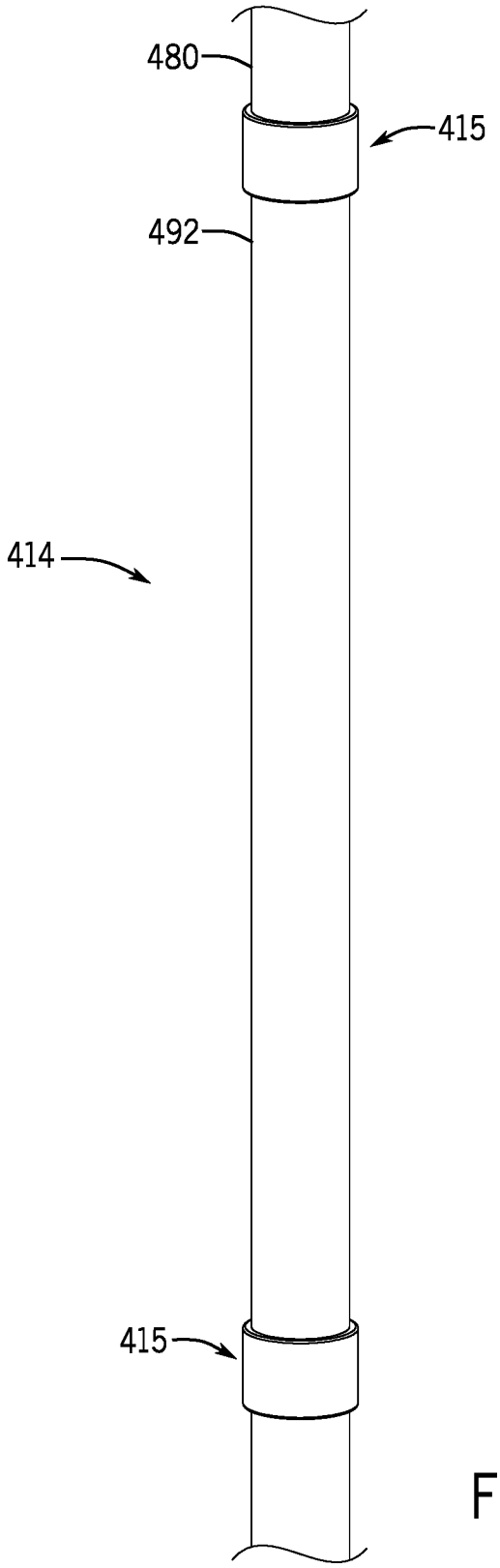
FIG. 4E is a side view of an assembled mop handle, according to an embodiment of the present disclosure.

FIG. 4E is a side view of an assembled mop handle 414, according to an embodiment of the present disclosure. The mop handle 414 is an embodiment of the mop handle 114 of FIGS. 1A and 1C. The mop handle 414 includes a number of pole connector systems 115 connecting poles, such as poles 490 and 492.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A system, comprising:

a mop bucket, comprising:

an attachment mechanism;

a first chamber, comprising:

a first open top; and a first-chamber wall comprising:

a first portion;

a second portion shaped to receive a mop head and a mop handle that is rotatable with respect to the mop head and;

an opening proximate to a bottom side of the mop bucket;

a second chamber, comprising:

a second open top;

a first second-chamber wall comprising the second portion of the first-chamber wall; and a second second-chamber wall;

a third chamber, comprising:

an third open top;

an outlet positioned proximate to the bottom side of the mop bucket; and a third-chamber wall comprising the first portion of the first-chamber wall and the second second-chamber wall; and a rotatable knob coupled to the second portion of the first-chamber wall and comprising a lever configured to:

expose the opening of the second portion of the first-chamber wall when the knob is rotated in a first axial direction; and cover the opening when the knob is rotated in a second axial direction opposite to the first axial direction;

a lid for the mop bucket, comprising:

a lid attachment mechanism configured to removably attach the lid to the mop bucket;

a first opening configured to receive clean water into the first chamber while the lid is attached to the mop bucket;

a second opening providing access to the second chamber while the lid is attached to the mop bucket and configured to receive a mop head and a mop handle that is rotatable with respect to the mop head;

a third opening configured to allow dirty water to pass through from the third chamber while the lid is attached to the mop bucket; and a fourth opening positioned between the first opening and the second opening and configured to receive the knob such that the knob is rotatable while the knob is received by the fourth opening.

2. The system of claim 1, the second opening comprising a first edge, the first edge comprising an outward protrusion of the opening shaped to accommodate the mop handle of the.

3. The system of claim 2, the second opening further comprising a second edge opposite the first edge, the second edge comprising a scraper facing an interior of the second opening and configured to contact the mop head as the mop head moves through the second opening.

4. The system of claim 1, further comprising a mop bucket handle rotatably coupled to at least one interior surface of the mop bucket.

* * * * *